United States Patent [19]

Cavanagh

[11] Patent Number: 4,506,462

[45] Date of Patent: Mar. 26, 1985

[54] RUNNING SHOE SOLE WITH PRONATION LIMITING HEEL

[75] Inventor: Peter R. Cavanagh, Pine Grove Mills, Pa.

[73] Assignee: Puma-Sportschuhfabriken Rudolf Dassler KG, Herzogenaurach, Fed. Rep. of Germany

[21] Appl. No.: 387,667

[22] Filed: Jun. 11, 1982

[51] Int. Cl.[3] ..... A43B 7/16

[52] U.S. Cl. ..... 36/92; 36/114; 36/30 R; 36/31; 36/129

[58] Field of Search ..... 36/35 A, 34 R, 37, 129, 36/92, 32 R, 30 R, 31, 114

[56] References Cited

U.S. PATENT DOCUMENTS

| | | | |
|---|---|---|---|
| 1,818,731 | 8/1931 | Mattison | 36/35 A |
| 3,738,373 | 6/1973 | Glancy | 36/35 A |
| 4,069,601 | 1/1978 | Robbins et al. | 36/32 R X |
| 4,237,627 | 12/1980 | Turner | 36/129 |
| 4,316,332 | 2/1982 | Giese et al. | 36/37 X |
| 4,364,188 | 12/1982 | Turner et al. | 36/129 X |
| 4,364,189 | 12/1982 | Bates | 36/129 X |

*Primary Examiner*—Werner H. Schroeder
*Assistant Examiner*—Tracy Graveline
*Attorney, Agent, or Firm*—Sixbey, Friedman & Leedom

[57] ABSTRACT

A running shoe sole having a relatively thin outer sole layer of hard, wear-resistant material, a midsole layer resilient cushioning material and a heel sole layer, provided between the outer sole and midsole layers along approximately the rear half of the sole. In accordance with preferred embodiments, an outer, longitudinally extending portion of the heel sole layer spans approximately $\frac{2}{3}$ of the width of the heel sole layer and is formed of a resilient cushioning material, while an inner portion spanning approximately the remaining $\frac{1}{3}$ of the width of the sole layer is formed of a material that is of a hardness of approximately 10–20 shore durometer greater than that of the outer portion of the heel sole layer. This construction of the heel sole layer enables cushioning of the foot during lateral heel strikes occurring during running to be provided by the outer portion of the heel while the inner portion is able to act in a manner which limits pronation occurring thereafter.

8 Claims, 5 Drawing Figures

RUNNING SHOE SOLE WITH PRONATION LIMITING HEEL

BACKGROUND OF THE INVENTION

The present invention relates to the field of running shoes and, in particular, to running shoe soles which are formed of a lightweight, multilayered or otherwise non-homogeneous construction. The present invention also relates to the problem of excess "pronation".

As described in detail in my book entitled *The Running Shoe Book,* Anderson World, Inc., 1980, during running, initial contact between a runner's shoe and the ground occurs at the outside or lateral edge of the shoe and not the back edge thereof, as occurs during walking (see upper illustration, FIG. 4). After landing on the lateral border of the shoe, the foot and the shoe tend to shift quickly into a flat position (central illustration, FIG. 4). This flattening out of the foot involves the subtalar joint (which is the joint between the talus and the heel bone). From the flat position, this lateral rolling motion then continues into the condition known as "pronation" (lower illustration, FIG. 4), wherein the foot is angled inwardly upon its inside edge. This lateral rolling movement into pronation only causes trouble when pronation does not stop within what is considered a normal range. Since pronation involves a rotation at the subtalar joint, it involves both the leg and the foot, so that as the subtalar joint pronates, the leg rotates inward. If there is too much pronation, a large amount of inward rotation occurs which produces a screwing type of motion at the knee joint. This screwing type of motion is one that the knee is not designed to resist, so that, when excessive amounts of prontation occur, the runner's knee joint is likely to be injured.

A very old technique for correction of pronation is known as as the "varus wedge" and is designed so that the platform where the foot is placed is higher on the inside of the shoe than the outside. This is accomplished by tapering the midsole (at an angle usually of between 4° and 8°), so that it is thicker on the inside border. This turns the rear foot in toward the midline of the body, so as to bring the subtalar joint into a neutral position. However, since all runners do not pronate to the same degree, and some do not pronate at all, some podiatrists feel that a varus wedge should be prescribed on a custom basis by a doctor and not utilized as a "standardized wedge" in commercially mass-produced shoes. For example, use of a shoe with a varus wedge by a runner who does not pronate could cause the runner to literally fall off the outside of his shoe, and may increase his risk of both inversion sprains of the ankle and knee pain.

In the area of running shoes, especially those used for competition, great emphasis has been placed on reducing the weight of the running shoe. Additionally, numerous techniques have been developed for increasing the cushioning provided for the foot during initial contact of the shoe with the ground.

U.S. Pat. No. 4,235,026 discloses an elastomeric shoe sole wherein the heel of the outsole is structured to yield a greater amount at the outer side than at the inner side thereof for the purpose of reducing the effect of the impact on this portion of the bottom of the foot which is repeatedly subjected to high impacts during running. This greater yieldability is achieved by a plurality of openings which extend from the outer side of the sole transversely through the heel of the sole substantially at right angles to the longitudinal center line to approximately the longitudinal center line of the outsole of the heel. While such a structuring of the heel end of the sole, in accordance with this patent, enables the foot at the heel end to roll about its longitudinal axis through such a distance as to reduce the force of impact by slowing the deceleration of the foot, thereby cushioning the foot to an acceptable amount, since the imperforate region of the heel of the sole is an elastomeric as utilized conventionally in athletic shoes (i.e., is a resilient cushioning material), it offers no pronation limiting capabilities, particularly in view of the increased rolling action produced by increasing the yieldability of the outer side of the heel.

U.S. Pat. No. 4,128,950 discloses an athletic shoe having a multilayered sole with an improved foam midsole. The multilayered sole of this patent includes an outersole layer of hard resilient wear-resistant rubber material, an intermediate sole layer of resilient lightweight synthetic plastic foam cushioning material, and a heel sole layer of similar material disposed between the intermediate sole layer and the outer sole. In comparison to a standard crepe rubber as used in athletic shoe sole layers (which has a hardness durometer of 44–46), plastic foam materials described in this patent have a hardness durometer of 26–37. While such synthetic plastic foams are very lightweight, their compliancy can allow the wearer's foot to twist when it strikes the ground, so that this patent recommends use of a stabilizer to increase lateral stability of the shoe. More particularly, a thin rectangular stabilizer plate of about 1/16 inch thick semi-rigid, solid synthetic plastic (such as nylon, polyethylene or polypropylene) is located between the intermediate sole layer and the heel sole layer. This stabilizer plate is relatively narrow and either extends fully across the heel or can terminate approximately in a quarter of the distance from the outside of the sole, so as to provide lateral stability on the inside of the sole, but allow some flexibility at the outside thereof. However, due to the fact that the disclosed stabilizer plate is located between two highly compliant foam layers, and is of only a limited front-to-back extent, it can, at best, have only a limited effect on pronation. Furthermore, provision of such a plate increases the manufacturing costs associated with producing the sole. As an alternative stabilizer, this patent also discloses constructing the heel sole layer so as to have an inner core of a lightweight, low density synthetic plastic foam material which is surrounded by an outer border portion of a harder, higher density material, such as a relatively dense, resilient closed cell foam material or a standard crepe rubber. Not only does such an arrangement unnecessarily increase the weight and reduce the compliancy of the sole at the outer border and central rear border of the heel, but, since the harder, border material is merely of the same hardness and resiliency as conventional athletic sole layers, it is no more effective in reducing pronation than a sole having a heel of 100% standard athletic shoe sole layer material.

SUMMARY OF THE INVENTION

In view of the foregoing, it is an object of the present invention to provide an improved multi-layered sole for a running shoe, which will effectively act to prevent excessive pronation, without sacrificing lightness and adequate cushioning.

It is a further object of the present invention to provide a multi-layered running shoe sole that can be easily and cost-effectively produced, while achieving the foregoing object.

These objects are achieved in accordance with preferred embodiments of the present invention by constructing the running shoe sole with a heel sole layer which comprises an outer, longitudinally extending, portion and an inner, longitudinally extending, portion, the outer portion spanning approximately $\frac{2}{3}$ of the width of the heel sole layer and being formed of a resilient cushioning material, and the inner portion spanning approximately $\frac{1}{3}$ of the width of the sole layer and being formed of a material that is of a hardness approximately 10 to 20 Shore durometer greater than that of the outer portion of the heel sole layer.

In accordance with a particular preferred embodiment, the inner and outer portions of the heel sole layer both extend the length of the heel sole layer, but a forward portion of the inner heel sole layer portion is provided with perforations in a region of the arch of the sole for reducing the weight and increasing the resiliency thereof. This construction is particularly advantageous from a manufacturing standpoint.

The midsole layer and the outer portion of the heel sole layer, as well as the above-noted perforated arch region have approximately the same cushioning properties, the midsole and outer heel sole portion being preferably a synthetic foam material. On the other hand, the less resilient heel sole inner portion may be formed of either a denser foam material or a non-cellular rubber-type material.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
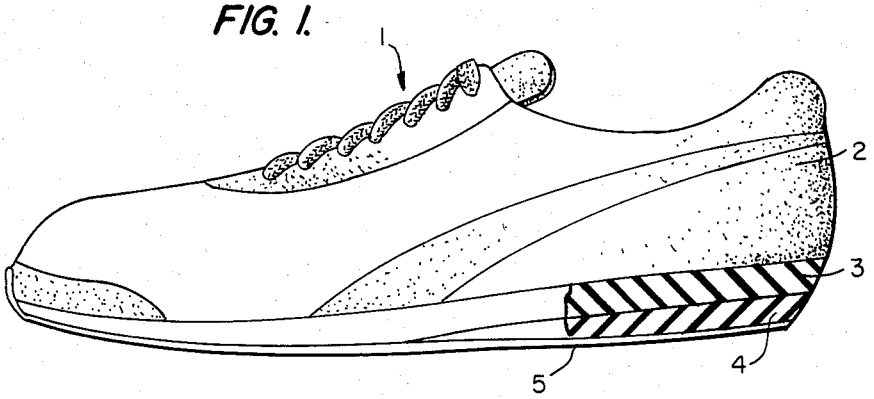
FIG. 1 is a side elevational view, partly in cross section, illustrating a running shoe for a left foot in accordance with the present invention.

With reference to FIG. 1, wherein a running shoe 1, having a standard upper 2, is provided with a sole in accordance with the present invention, it can be seen that the sole has three basic layers. Closest to the upper and attached directly thereto is the midsole 3. In the rear 50% of the shoe (from the arch rearwardly), a heel sole layer 4 supports the midsole. These layers 3, 4 are then covered externally by a relatively thin, outer sole layer.

Figure 2:
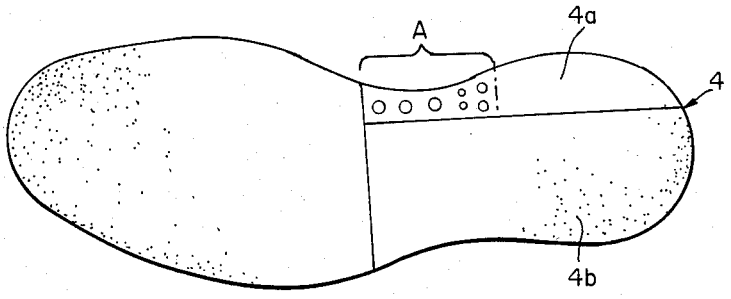
FIG. 2 is a bottom plan view of the running shoe for the right foot of FIG. 1, with the outer sole layer removed.

With reference to FIG. 2, it can be seen that the heel sole layer 4 is composed of two longitudinally extending portions 4*a*, 4*b*. Inner portion 4*a* spans approximately $\frac{1}{3}$ of the width of the heel on the medial side of the running shoe sole, while outer portion 4*b* spans approximately the remaining $\frac{2}{3}$ thereof on its lateral side. Outer portion 4*b* is formed of a conventional sole material (preferably a synthetic foam material), while the inner sole portion 4*a* is of a material that is harder than materials conventionally utilized in running shoes, having a hardness of approximately 10–20 durometer greater than that of the material used for sole portion 4*b*. This harder material can either be a synthetic foam material of greater density than that of portion 4*b*, or it can be a non-cellular rubber-type material.

Figure 3:
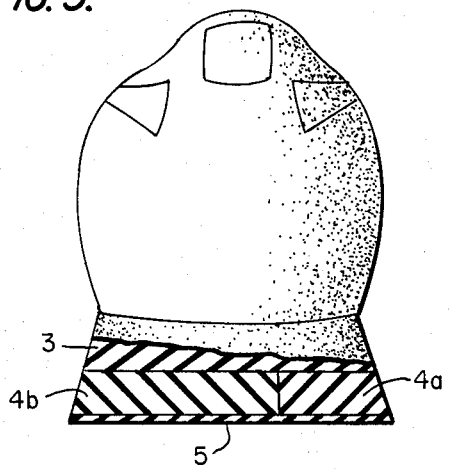
FIGS. 3 and 3*a* are partial cross-sectional views of the rear of the heel of the running shoe for the left foot of FIG. 1.
Figure 3A:
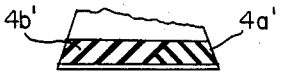

While inner portion 4*a* of the heel sole layer 4 need only extend forwardly up to the beginning of the arch area of the shoe, for manufacturing reasons it is advantageous to have this area coextensive with portion 4*b*, which extends the length of the heel sole layer (such heel sole layers, as shown, conventionally extending to the forward side of the arch region A). However, when inner portion 4*a* extends through the arch region A, as shown, because of the fact that harder materials are generally heavier, as well as less resilient, in accordance with the illustrated embodiment, perforations are drilled or molded into the forward portion of inner portion 4*a* in arch region A in order to reduce the weight of the sole and to increase resiliency and flexibility in the arch region to an extent corresponding to that of outer portion 4*b*. While the transition between portions 4*a* and 4*b* of the heel sole layer 4 can be along a longitudinal, vertical plane, as illustrated in FIG. 3, it is preferred that the outer portion 4*b*′ of the heel sole layer mate and overlie with the inner portion 4*a*′ along a longitudinally-extending, laterally-sloping plane, as shown in FIG. 3*a*. This is because a sloping interface should provide a more durable union between the two portions and greater comfort to the wearer by providing a transition region of progressively changing resiliency and vertical forces serving to hold the joint together, instead of an abrupt junction along a vertical plane.

The relationship between the midsole layer 3 and the heel sole layer 4 is of particular importance since it is a primary shock absorber in a running shoe. Thus, because of the increased hardness of inner portion 4*a* of the heel sole layer, it is imperative that the midsole layer extend thereover and be of a resilient cushioning material (such as a lightweight, snythetic foam) for otherwise a sole layer of 60 or 65 Shore durometer would be too hard to use in a running shoe due to its lack of cushioning properties. Thus, as shown in FIG. 3, the midsole layer 3 extends across substantially the full width of the sole and is of substantially uniform height thereacross. Similarly, it is important that as much of the midsole as possible be effectively utilized for cushioning. For this reason, the outer portion 4*b* is as wide as possible (i.e., $\frac{2}{3}$ of the width of the heel) and is preferably formed of the same or a similarly resilient cushioning material. In this regard, it has been found particularly advantageous if the midsole and outer portion 4*b* of the heel sole layer are of a material having a 45–50 Shore durometer hardness, while the inner portion of the heel sole layer 4*a* has a hardness of 60–65 Shore durometer.

In addition to the usual reasons for using an outer sole, provision of a relatively thin outer sole layer of relatively hard, wear-resistant material, is particularly important in accordance with the present invention in order to avoid a cushioning interface between the ground and the pronation preventing, inner portion 4*a*. A $\frac{1}{8}$ inch rubber covering may be used for this purpose, and, for similar reasons, no resilient cushioning cleats or studs should be provided on the outer sole in the area of the heel, although a relatively shallow groove-type tread may be provided for traction purposes.

Figure 4:
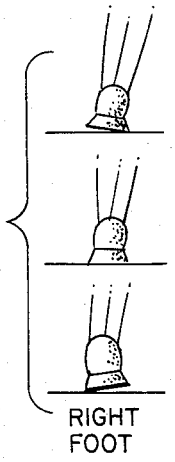
FIG. 4 is a schematic illustration depicting the lateral rolling motion which occurs between a shoe and the ground during running.

From the foregoing, it should be apparent that, during running, initial contact at the outer lateral border of the shoe can be maximally absorbed by the midsole 3 and heel layer portion 4*b*, which will continue impact absorption as the shoe rolls into the neutral position (central illustration, FIG. 4) due to the substantial width of portion 4*b*. However, once the neutral position is attained, the rigid portion 4*a* is brought into contact with the ground and, due to its relative lack of compliancy, it will act to inhibit continued rolling movement, so that pronation will be limited and excessive pronation will be avoided. On the other hand, since unlike the varus wedge, noted above, portion 4*a* does not shift the orientation of the runner's foot during initial strike, it does not pose any hazard when used by runners whose running motion is not subject to pronation.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A running shoe sole comprising:

A. a relatively thin outer sole layer of relatively hard, wear-resistant material;

B. a midsole layer of resilient cushioning material for direct attachment to an upper of a running shoe, said midsole layer extending across substantially the full width of the running shoe sole and being of substantially uniform thickness and hardness thereacross; and C. a heel sole layer provided between said outer sole layer and said midsole layer along approximately a rear half of the running shoe sole;

wherein said heel sole layer comprises an outer, longitudinally extending, portion on the lateral side of the running shoe sole and an inner, longitudinally extending, portion on the medial side of the running shoe sole, said outer portion spanning approximately two-thirds of the width of the heel sole layer and being formed of a resilient cushioning material having approximately the same cushioning properties as the overlying material of the midsole layer, and said inner portion spanning approximately one-third of the width of the sole layer and being formed of a material that is of a hardness approximately 10–20 durometer greater than that of said outer portion, whereby said outer portion provides cushioning during lateral heel strikes occurring during running and said inner portion serves as a means acting for limiting pronation occurring thereafter.

2. A running shoe sole according to claim 1, wherein said inner portion of the heel sole layer has a hardness of 60–65 Shore durometer.

3. A running shoe sole according to claim 1, wherein said outer portion of the heel sole layer is of a material having 40–50 Shore durometer hardness.

4. A running shoe sole according to claim 3, wherein the midsole layer and the outer portion of the heel sole layer are formed of a synthetic foam material, and the inner portion of the heel sole layer is formed of a noncellular rubber-type material.

5. A running shoe sole according to claim 3, wherein the midsole layer and the outer portion of the heel sole layer are formed of a synthetic foam material, and the inner portion of the heel sole layer is formed of a synthetic foam material of a greater density than that of which the midsole and outer portion of the heel sole layer are formed.

6. A running shoe sole according to claim 3, wherein said inner portion of the heel sole layer extends the length of the heel sole layer and a forward portion thereof is provided with perforations in a region of the arch of the sole for reducing the weight and increasing the resiliency thereof.

7. A running shoe sole according to claim 3, wherein said inner portion of the heel sole layer has a hardness of 60–65 Shore durometer.

8. A running shoe sole according to claim 7, wherein said outer portion of the heel sole layer mates with and overlies the inner portion thereof along a longitudinally extending, laterally sloping plane.

* * * * *